US007328610B2

(12) United States Patent
Manin et al.

(10) Patent No.: US 7,328,610 B2
(45) Date of Patent: Feb. 12, 2008

(54) METHOD FOR MEASURING FORMATION PROPERTIES WITH A FORMATION TESTER

(75) Inventors: Yves Manin, Clamart Cedex (FR); François Liger, Clamart Cedex (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 29 days.

(21) Appl. No.: 11/349,513

(22) Filed: Feb. 6, 2006

(65) Prior Publication Data

US 2006/0191332 A1 Aug. 31, 2006

(51) Int. Cl.
*E21B 49/00* (2006.01)

(52) U.S. Cl. ..... 73/152.02

(58) Field of Classification Search ..... 73/152.02, 73/152.38, 152.51, 152.54
See application file for complete search history.

(56) References Cited

U.S. PATENT DOCUMENTS

| | | | | |
|---|---|---|---|---|
| 4,597,290 | A * | 7/1986 | Bourdet et al. | 73/152.37 |
| 5,184,508 | A * | 2/1993 | Desbrandes | 73/152.05 |
| 5,233,866 | A * | 8/1993 | Desbrandes | 73/152.05 |
| 2002/0112854 | A1 | 8/2002 | Krueger et al. | |
| 2004/0050588 | A1 | 3/2004 | Follini et al. | |

FOREIGN PATENT DOCUMENTS

| | | |
|---|---|---|
| EP | 0698722 | 2/1996 |

* cited by examiner

*Primary Examiner*—Daniel S. Larkin
*Assistant Examiner*—John Fitzgerald

(74) *Attorney, Agent, or Firm*—Kevin P. McEnaney; Dale Gaudier

(57) ABSTRACT

A method is disclosed for estimating a formation pressure using a formation tester disposed in a wellbore penetrating a formation, said method comprising: (a) establishing fluid communication between a pretest chamber in the downhole tool and the formation via a flowline, the flowline having an initial pressure therein; (b) moving a pretest piston in a controlled manner in the pretest chamber to reduce the initial pressure to a drawdown pressure during a drawdown phase; (c) terminating movement of the piston to permit the drawdown pressure to adjust to a stabilized pressure during a build-up phase and measuring simultaneously in relation to time, pressure P(t) and temperature T(t) in the pretest chamber; (d) extracting an index i(t) dependent of the pressure P(t) and the temperature T(t) informing on the build-up phase; (e) analyzing index i(t) and repeating steps (b)-(d) or going to step (f); (f) determining the formation pressure based on a final stabilized pressure in the flowline. And more generally a method could be used for estimating type of a build up pressure phase, the build up pressure phase being done after a drawdown pressure phase, said both drawdown and build up phases being done to determine formation pressure using a formation tester disposed in a wellbore penetrating a permeable formation, said permeable formation being able to create a formation flow, said method being characterized by using an index to determine the contribution of formation flow on the pressure build up phase.

14 Claims, 6 Drawing Sheets

METHOD FOR MEASURING FORMATION PROPERTIES WITH A FORMATION TESTER

CROSS REFERENCE TO RELATED APPLICATIONS

This application claims priority to European patent application 05290452.1 filed Feb. 28, 2005.

FIELD OF THE INVENTION

The present invention relates generally to the field of oil and gas exploration. More particularly, the invention relates to methods for determining at least one property of a subsurface formation penetrated by a wellbore using a formation tester.

DESCRIPTION OF THE PRIOR ART

Over the past several decades, highly sophisticated techniques have been developed for identifying and producing hydrocarbons, commonly referred to as oil and gas, from subsurface formations. These techniques facilitate the discovery, assessment, and production of hydrocarbons from subsurface formations.

When a subsurface formation containing an economically producible amount of hydrocarbons is believed to have been discovered, a borehole is typically drilled from the earth surface to the desired subsurface formation and tests are performed on the formation to determine whether the formation is likely to produce hydrocarbons of commercial value. Typically, tests performed on subsurface formations involve interrogating penetrated formations to determine whether hydrocarbons are actually present and to assess the amount of producible hydrocarbons therein. These preliminary tests are conducted using formation testing tools, often referred to as formation testers. Formation testers are typically lowered into a wellbore by a wireline cable, tubing, drill string, or the like, and may be used to determine various formation characteristics which assist in determining the quality, quantity, and conditions of the hydrocarbons or other fluids located therein. Other formation testers may form part of a drilling tool, such as a drill string, for the measurement of formation parameters during the drilling process.

Formation testers typically comprise slender tools adapted to be lowered into a borehole and positioned at a depth in the borehole adjacent to the subsurface formation for which data is desired. Once positioned in the borehole, these tools are placed in fluid communication with the formation to collect data from the formation. Typically, a probe, snorkel or other device is sealably engaged against the borehole wall to establish such fluid communication.

Formation testers are typically used to measure downhole parameters, such as wellbore pressures, formation pressures and formation mobilities, among others. They may also be used to collect samples from a formation so that the types of fluid contained in the formation and other fluid properties can be determined. The formation properties determined during a formation test are important factors in determining the commercial value of a well and the manner in which hydrocarbons may be recovered from the well.

The operation of formation testers may be more readily understood with reference to the structure of a conventional wireline formation tester shown in FIGS. 1A and 1B. As shown in FIG. 1A, the wireline tester 100 is lowered from an oil rig 2 into an open wellbore 3 filled with a fluid commonly referred to in the industry as "mud." The wellbore is lined with a mudcake 4 deposited onto the wall of the wellbore during drilling operations. The wellbore penetrates an earth formation 5.

The operation of a conventional modular wireline formation tester having multiple interconnected modules is described in more detail in U.S. Pat. Nos. 4,860,581 and 4,936,139 issued to Zimmerman et al. FIG. 2 depicts a graphical representation of a pressure trace over time measured by the formation tester during a conventional wireline formation testing operation used to determine parameters, such as formation pressure.

Referring now to FIGS. 1A and 1B, in a conventional wireline formation testing operation, a formation tester 100 is lowered into a wellbore 3 by a wireline cable 6. After lowering the formation tester 100 to the desired position in the wellbore, pressure in the flowline 119 in the formation tester may be equalized to the hydrostatic pressure of the fluid in the wellbore by opening an equalization valve (not shown). A pressure sensor or gauge 120 is used to measure the hydrostatic pressure of the fluid in the wellbore. The measured pressure at this point is graphically depicted along line 103 in FIG. 2. The formation tester 100 may then be "set" by anchoring the tester in place with hydraulically actuated pistons, positioning the probe 112 against the sidewall of the wellbore to establish fluid communication with the formation, and closing the equalization valve to isolate the interior of the tool from the well fluids. The point at which a seal is made between the probe and the formation and fluid communication is established, referred to as the "tool set" point, is graphically depicted at 105 in FIG. 2. Fluid from the formation 5 is then drawn into the formation tester 100 by retracting a piston 118 in a pretest chamber 114 to create a pressure drop in the flowline 119 below the formation pressure. This volume expansion cycle, referred to as a "drawdown" cycle, is graphically illustrated along line 107 in FIG. 2.

When the piston 118 stops retracting (depicted at point 111 in FIG. 2), fluid from the formation continues to enter the probe 112 until, given a sufficient time, the pressure in the flowline 119 is the same as the pressure in the formation 5, depicted at 115 in FIG. 2. This cycle, referred to as a "build-up" cycle, is depicted along line 113 in FIG. 2. As illustrated in FIG. 2, the final build-up pressure at 115, frequently referred to as the "sandface" pressure, is usually assumed to be a good approximation to the formation pressure.

The shape of the curve and corresponding data generated by the pressure trace may be used to determine various formation characteristics. For example, pressures measured during drawdown (107 in FIG. 2) and build-up (113 in FIG. 2) may be used to determine formation mobility, that is the ratio of the formation permeability to the formation fluid viscosity. When the formation tester probe (112 FIG. 1B) is disengaged from the wellbore wall, the pressure in flowline 119 increases rapidly as the pressure in the flowline equilibrates with the wellbore pressure, shown as line 117 in FIG. 2. After the formation measurement cycle has been completed, the formation tester 100 may be disengaged and repositioned at a different depth and the formation test cycle repeated as desired.

During this type of test operation for a wireline-conveyed tool, pressure data collected downhole is typically communicated to the surface electronically via the wireline communication system. At the surface, an operator typically monitors the pressure in flowline 119 at a console and the wireline logging system records the pressure data in real time. Data recorded during the drawdown and buildup cycles of the test may be analyzed either at the well site computer in real time or later at a data processing center to determine crucial formation parameters, such as formation fluid pressure, the mud overbalance pressure, i.e. the difference between the wellbore pressure and the formation pressure, and the mobility of the formation.

Wireline formation testers allow high data rate communications for real-time monitoring and control of the test and tool through the use of wireline telemetry. This type of communication system enables field engineers to evaluate the quality of test measurements as they occur, and, if necessary, to take immediate actions to abort a test procedure and/or adjust the pretest parameters before attempting another measurement. For example, by observing the data as they are collected during the pretest drawdown, an engineer may have the option to change the initial pretest parameters, such as drawdown rate and drawdown volume, to better match them to the formation characteristics before attempting another test. Examples of prior art wireline formation testers and/or formation test methods are described, for example, in U.S. Pat. No. 3,934,468 issued to Brieger; U.S. Pat. Nos. 4,860,581 and 4,936,139 issued to Zimmerman et al.; and U.S. Pat. No. 5,969,241 issued to Auzerais. These patents are assigned to the assignee of the present invention.

Formation testers may also be used during drilling operations. For example, one such downhole tool adapted for collecting data from a subsurface formation during drilling operations is disclosed in U.S. Pat. No. 6,230,557 B1 issued to Ciglenec et al., which is assigned to the assignee of the present invention.

Various techniques have been developed for performing specialized formation testing operations, or pretests. For example, U.S. Pat. Nos. 5,095,745 and 5,233,866 both issued to DesBrandes describe a method for determining formation parameters by analyzing the point at which the pressure deviates from a linear draw down.

Despite the advances made in developing methods for performing pretests, there remains a need to eliminate delays and errors in the pretest process, and to improve the accuracy of the parameters derived from such tests. Because formation testing operations are used throughout drilling operations, the duration of the test and the absence of real-time communication with the tools are major constraints that must be considered. The problems associated with real-time communication for these operations are largely due to the current limitations of the telemetry typically used during drilling operations, such as mud-pulse telemetry. Limitations, such as uplink and downlink telemetry data rates for most logging while drilling or measurement while drilling tools, result in slow exchanges of information between the downhole tool and the surface. For example, a simple process of sending a pretest pressure trace to the surface, followed by an engineer sending a command downhole to retract the probe based on the data transmitted may result in substantial delays which tend to adversely impact drilling operations.

Furthermore, delays also increase the possibility of tools becoming stuck in the wellbore. To reduce the possibility of sticking, drilling operation specifications based on prevailing formation and drilling conditions are often established to dictate how long a drill string may be immobilized in a given borehole. Under these specifications, the drill string may only be allowed to be immobile for a limited period of time to deploy a probe and perform a pressure measurement. Due to the limitations of the current real-time communications link between some tools and the surface, it may be desirable that the tool be able to perform almost all operations in an automatic mode. For example, U.S. Patent Application No. 2004/00457006 assigned to the assignee of the present invention describes a method for determining formation parameters by using a tool being able to perform operations in an automatic mode in a limited period of time. Nevertheless, in this automatic mode, some steps are sometimes redundant or useless, increasing the time spends on non useful information during this limited period of time and increasing the possibility of tool becoming stuck in the wellbore.

Therefore, the aim of the present invention is to describe a method to perform formation test measurements downhole within a minimum period of time and that may be easily implemented using wireline or drilling tools resulting in minimal intervention from the surface system.

SUMMARY OF THE INVENTION

The invention provides a method for estimating type of a build up pressure phase, the build up pressure phase being done after a drawdown pressure phase, said both drawdown and build up phases being done to determine formation pressure using a formation tester disposed in a wellbore penetrating a permeable formation, said permeable formation being able to create a formation flow, said method being characterized by using an index to determine the contribution of formation flow on the pressure build up phase.

In a further aspect of the invention, a method is disclosed for estimating a formation pressure using a formation tester disposed in a wellbore penetrating a formation, said method comprising: (a) establishing fluid communication between a pretest chamber in the downhole tool and the formation via a flowline, the flowline having an initial pressure therein; (b) moving a pretest piston in a controlled manner in the pretest chamber to reduce the initial pressure to a drawdown pressure during a drawdown phase; (c) terminating movement of the piston to permit the drawdown pressure to adjust to a stabilized pressure during a build-up phase and measuring simultaneously in relation to time, pressure P(t) and temperature T(t) in the pretest chamber; (d) extracting an index i(t) dependent of the pressure P(t) and the temperature T(t) informing on the build-up phase; (e) analyzing index i(t) and repeating steps (b)-(d) or going to step (f); (f) determining the formation pressure based on a final stabilized pressure in the flowline. The method can be directly applied to all formation tester known in the art.

Preferably, the index is a function dependent of the effects of thermodynamic equilibrium in the formation tester and the effects of formation flow into the formation tester. When the build up phase occurs after a drawdown of pressure, the thermodynamic equilibrium in the formation tester plays a part in the build up phase; and the formation flow, which enters into the formation tester, plays a part in the build up phase.

Preferably, the index is a function dependent of the effects of temperature variation in the formation tester and the effects of formation flow into the formation tester. For the thermodynamic equilibrium, the variation in temperature plays a major rule.

Preferably, the index i(t) is equal to:

$$\frac{\Delta T}{\Delta P} \cdot \frac{\delta^2(\log(\Delta P))}{\delta t^2},$$

where ΔT is the temperature variation, ΔP is the pressure variation and t the time. When the index function tends towards zero, the build up phase is due to contribution of formation flow and when not, the build up phase is due to contribution of temperature equilibrium.

BRIEF DESCRIPTION OF THE DRAWINGS

Further embodiments of the present invention can be understood with the appended drawings.

DETAILED DESCRIPTION

Figure 1B:
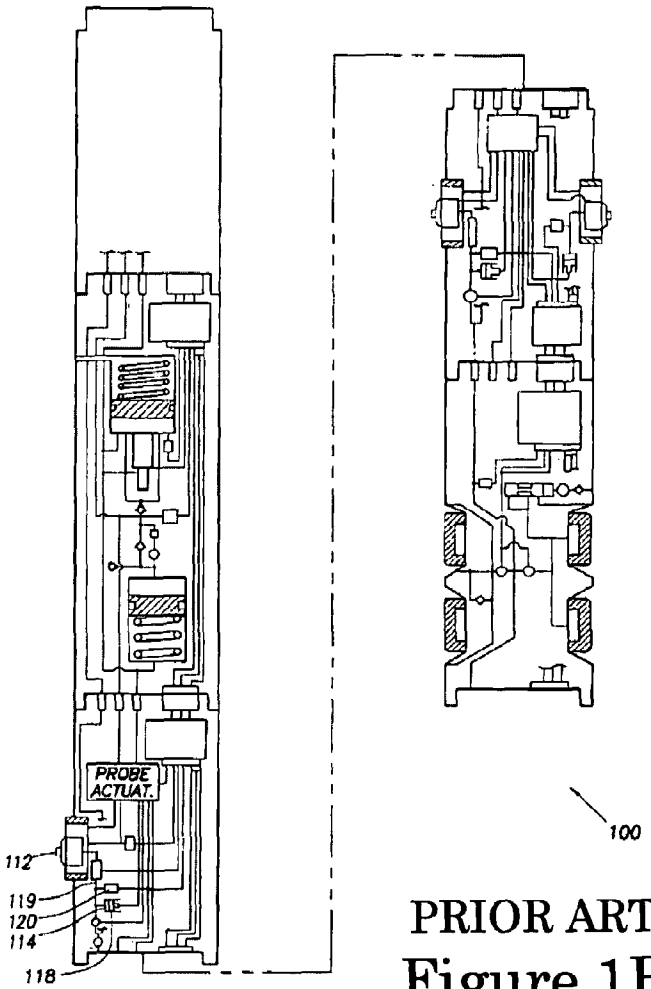
PRIOR ART Figure 1B
FIG. 1B shows a cross sectional view of the modular conventional wireline formation tester of FIG. 1A.
Figure 1A:
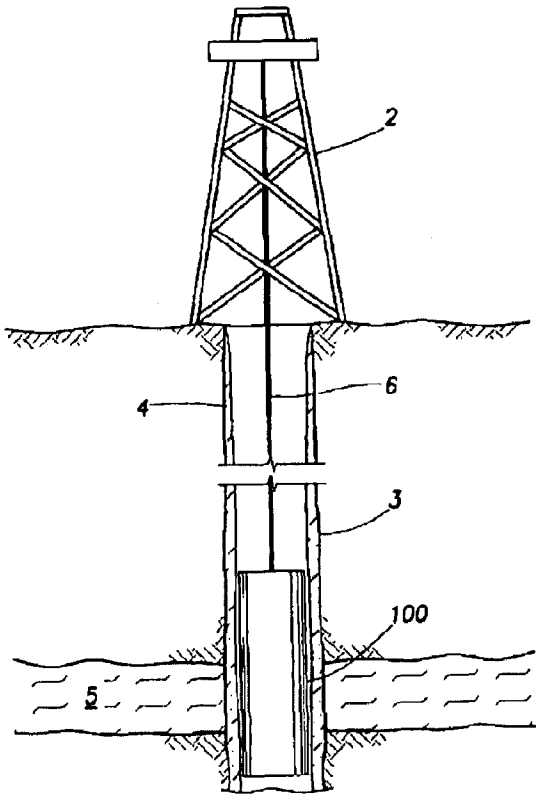
PRIOR ART Figure 1A
FIG. 1A shows a conventional wireline formation tester disposed in a wellbore from Prior Art.

An embodiment of the present invention relating to a method for estimating formation properties (e.g. formation pressures and mobilities) may be applied with any formation tester known in the art, such as the tester described with respect to FIGS. 1A and 1B. Other formation testers may also be used and/or adapted for embodiments of the invention, such as the wireline formation tester of U.S. Pat. Nos. 4,860,581 and 4,936,139 issued to Zimmerman et al. and the downhole drilling tool of U.S. Pat. No. 6,230,557 B1 issued to Ciglenec et al. The method of the present invention is an improvement of the method of U.S. Patent Application No. 2004/00457006 which discloses a method including an investigation phase and a measurement phase to estimate formation properties.

Figure 3:
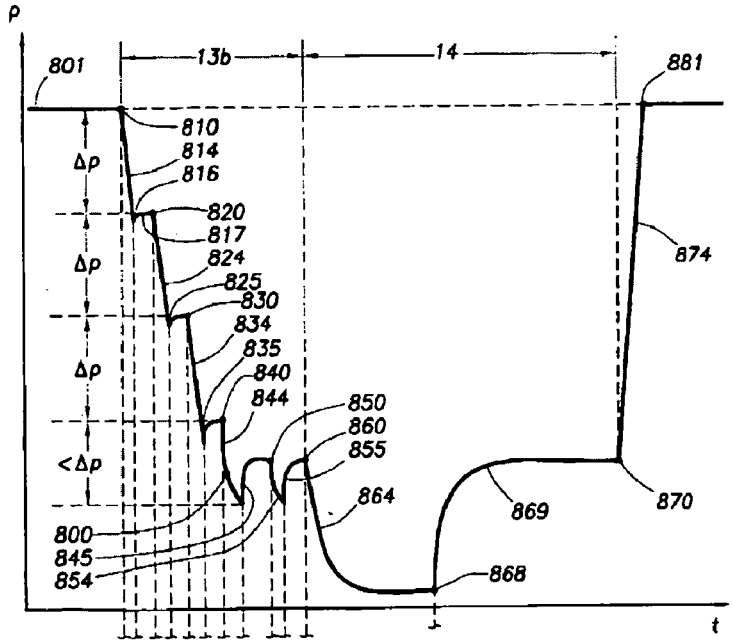
PRIOR ART Figure 3
FIG. 3 shows a graphical representation of a pressure measurements versus time plot for performing a pretest including a modified investigation phase the pretest as defined in U.S. Patent Application No. 2004/00457006.

In U.S. Patent Application No. 2004/00457006, the method consists in performing an investigation phase 13*b* with several drawdown steps. Referring to FIG. 3, the method comprises the step of starting the drawdown 810 and performing a controlled drawdown 814. It is preferred that the piston drawndown rate be precisely controlled so that the pressure drop and the rate of pressure change be well controlled. However, it is not necessary to conduct the pretest (piston drawdown) at low rates. When the prescribed incremental pressure drop (Δp) has been reached, the pretest piston is stopped and the drawdown terminated 816. The pressure is then allowed to equilibrate 817 for a period $t_i^0$, 818 which may be longer than the drawdown period $t_{pi}$ 817, for example, $t_i^o=2\ t_{pi}$. After the pressure has equilibrated, the stabilized pressure at point 820 is compared with the pressure at the start of the drawdown at point 810. At this point, a decision is made as to whether to repeat the cycle. The criterion for the decision is whether the equalized pressure (e.g., at point 820) differs from the pressure at the start of the drawdown (e.g., at point 810) by an amount that is substantially consistent with the expected pressure drop (Δp). If so, then this flowline expansion cycle is repeated.

To repeat the flowline expansion cycle, for example, the pretest piston is re-activated and the drawdown cycle is repeated as described, namely, initiation of the pretest 820, drawdown 824 by exactly the same amount (Δp) at substantially the same rate and duration 826 as for the previous cycle, termination of the drawdown 825, and stabilization 830. Again, the pressures at 820 and 830 are compared to decide whether to repeat the cycle. As shown in FIG. 3, these pressures are significantly different and are substantially consistent with the expected pressure drop (Δp) arising from expansion of the fluid in the flowline. Therefore, the cycle is repeated, 830-834-835-840. The "flowline expansion" cycle is repeated until the difference in consecutive stabilized pressures is substantially smaller than the imposed/prescribed pressure drop (Δp), shown for example in FIG. 3 as 840 and 850.

After the difference in consecutive stabilized pressures is substantially smaller than the imposed/prescribed pressure drop (Δp), the "flowline expansion" cycle may be repeated one more time, shown as 850-854-855-860 in FIG. 3. If the stabilized pressures at 850 and 860 are in substantial agreement, for example within a small multiple of the gauge repeatability, the larger of the two values is taken as the first estimate of the formation pressure. One of ordinary skill in the art would appreciate that the processes as shown in FIG. 3 are for illustration only. Embodiments of the invention are not limited by how many flowline expansion cycles are performed. Furthermore, after the difference in consecutive stabilized pressures is substantially smaller than the imposed/prescribed pressure drop (Δp), it is optional to repeat the cycle one or more times.

The point at which the transition from flowline fluid expansion to flow from the formation takes place is identified as 800 in FIG. 3. If the pressures at 850 and 860 agree at the end of the allotted stabilization time, it may be advantageous in certain conditions to allow the pressure 860 to continue the build up in order to obtain a better first estimate of the formation pressure. The process by which the decision is made to either continue the investigation phase or to perform the measurement phase, 864-868-869, to obtain a final estimate of the formation pressure 870 depends on certain criterions described in U.S. Patent Application No. 2004/00457006. After the measurement phase is completed 870, the probe is disengaged from the wellbore wall and the pressure returns to the wellbore pressure 874 within a time period 895 and reaches stabilization at 881.

As it can be understood the unknown value is the formation pressure 870, and a precise and quick method of measurement of this value is seeking. When the difference between wellbore pressure (801, 881) and natural formation pressure 870 is typically of 1500 psi (10 MPa), the method according to U.S. Patent Application No. 2004/00457006 is applicable: for example, with a prescribed incremental pressure drop (Δp) of 300 psi (2 MPa) the investigation and measurement phases will have the same aspect as shown in FIG. 3. Nevertheless, when the difference between wellbore pressure (801, 881) and formation pressure 870 is typically of 5000 psi (34.5 MPa), as for low or very low permeability rocks, the method according to U.S. Patent Application No. 2004/00457006 with a prescribed incremental pressure drop (Δp) of 300 psi (2 MPa) will take a very long time. Also, there is a possibility to increase the prescribed incremental pressure drop (Δp) for example by using a pressure drop of 1500 psi (10 MPa), however this solution will increase the time needed for a build up phase, because the time needed for the stabilization of the pressure will also be longer if using the same criterions described in U.S. Patent Application No. 2004/00457006. The build up phase depending on the formation mobility, if the formation mobility is smaller as for low or very low permeability rocks, the build up time will be longer. Therefore there is a need to find a quicker method to perform investigation and measurement phases.

The method according to the present invention is based on the use of an index, which will inform on the nature and the behavior of the build up phase. Effectively, if an index could directly inform at the beginning of the build up phase what is contributing to the pressure build up: contribution of the formation flow or thermodynamic equilibrium of the flowline, the further steps of investigation phase 13*b* on FIG. 3 could be reduced.

Figure 2:
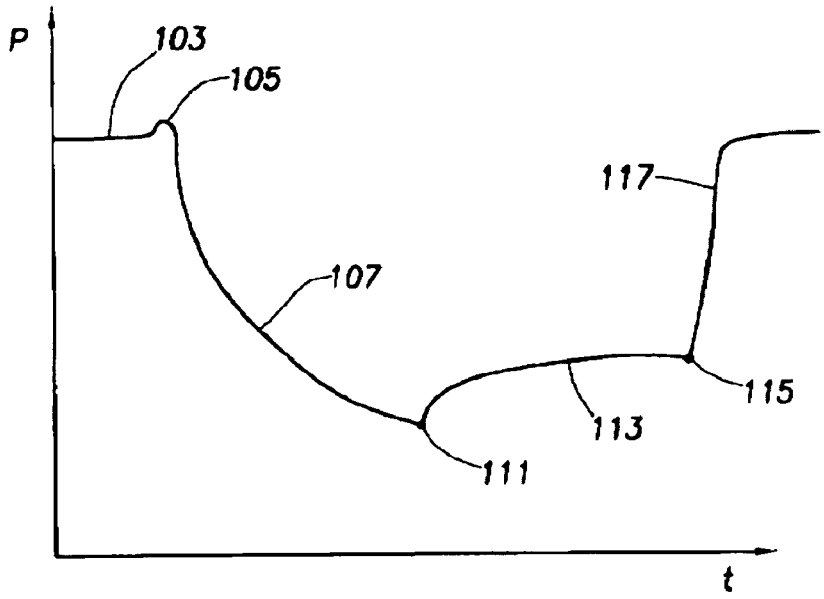
PRIOR ART Figure 2
FIG. 2 shows a graphical representation of pressure measurements versus time plot for a typical prior art pretest sequence performed using a conventional formation tester.
Figure 4:
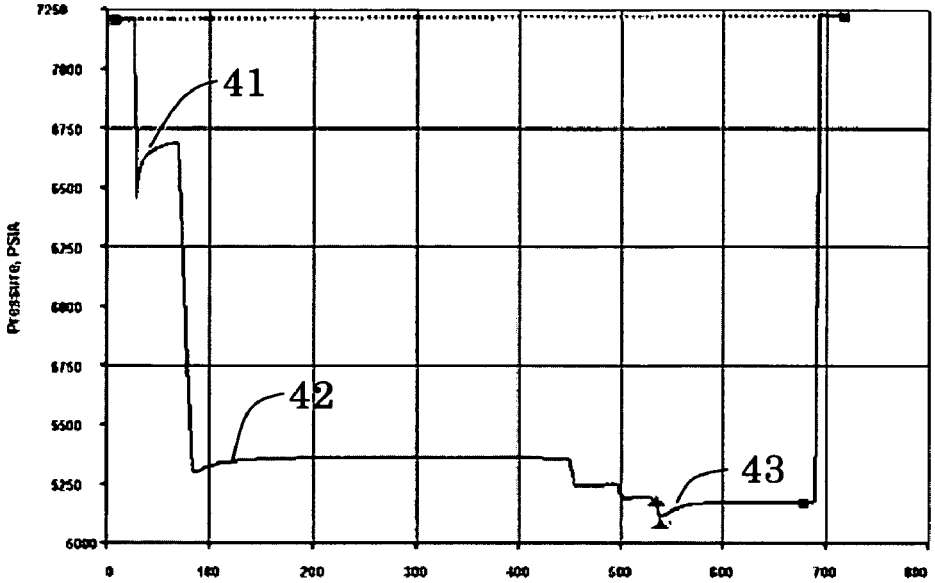
FIG. 4 shows a graphical representation of a pressure measurements versus time plot containing non-formation build up and formation build up.

As defined in FIG. 2, the formation pressure is obtained from the formation tester stabilized pressure build up value 115 after a given pretest drawdown 107. The stabilized pressure build up value is representative of the formation pressure at the condition that the pretest drawdown 107 is made lower than said stabilized pressure build up. This condition is nevertheless verified a priori, and in practice "pseudo build up" may occur when this condition is not verified (FIG. 4). Firstly, some formation testers feature a filter inside the probe; when the tool is not set a piston block the fluid path to the filter to avoid probe plugging. At the end of the tool set sequence, this piston retracts and allows access to the flowline. Thus, the flowline volume increases slightly and creates a pressure drop. The setting sequence continues for a few seconds until the final hydraulic pressure is reached. And during this few seconds the packer element of the formation tester is pressed against the formation and therefore causes the pressure in the flowline to increase. This first type of "pseudo build up" occurs only at the beginning of the pretest 41. Secondly, the pressure drop created during a drawdown cools the flowline, this cooling will be followed by a heating at the build up phase. This effect introduces a temperature gradient in the pressure sensor, affecting the measured pressure read. Furthermore, when the drawdown ends, thermodynamic equilibrium begins and the flowline tends to heat up to go back to the ambient temperature of the formation tester. This effect introduces an expansion of the flowline fluids, affecting also the measured pressure. This second type of "pseudo build up" can occur every time for a pretest drawdown 42. In FIG. 4, the time spent between 100 s and 400 s on a "pseudo build up" or non-formation build up 42 was useless.

In order to speed up the formation pressure measurement, it is essential to be able to define in real time in a build up phase whether the pressure should be let to increase or whether a further drawdown phase is necessary. The index is based on intrinsic characteristics of the pseudo build up phase of second type and on intrinsic characteristics of a genuine formation build up phase. So, the index takes into consideration the effects in variation of temperature (pseudo build up phase of second type) and the contribution of the formation flow on the pressure build up observed.

For the temperature effects, a relationship exists between temperature and pressure; and the value of the ratio ΔT/ΔP—the change in the pressure sensor temperature versus the change in pressure during a given time period—is used as an index. For a build up phase entirely governed by thermal effects, i.e. a non-formation build up, this ratio will be larger than for the case where the formation flow is contributing to the build up phase.

For the contribution of the formation flow, the early part of the build up phase is dominated by wellbore storage effects and the expression for the difference between the actual reservoir pressure $P_i$ and the pressure after Δt elapsed time into the build up is:

$$\Delta P = P_i - P(\Delta t) = [P_i - P_0]^{-\frac{\Delta t}{\tau}} \tag{1}$$

where $P_0$ is the pressure at the onset of the build up and τ is a time constant defined as:

$$\tau = \frac{\mu}{k} \cdot \frac{(2C+S) \cdot V \cdot C_f}{r_p} \tag{2}$$

with: m fluid viscosity
k formation permeability
C flow geometry coefficient
S skin
V flowline volume
$C_f$ fluid compressibility The equation (1) can be written in the following form:

$$\log(\Delta P) = -\log(P_i - P_0) \cdot \frac{\Delta t}{\tau} \tag{3}$$

As it can be observed log(ΔP) is a linear function of the elapsed time Δt. And it results that for the case where the formation flow is contributing alone to the build up phase, the condition (4) is satisfied:

$$\frac{\delta^2(\log(\Delta P))}{\delta t^2} = 0 \tag{4}$$

The index takes into consideration the both effects and is the product of the index contributing to thermal effects and on the index contributing to formation flow effects:

$$i(t) = \frac{\Delta T}{\Delta P} \cdot \frac{\delta^2(\log(\Delta P))}{\delta t^2} \tag{5}$$

In the case where there is no formation flow effects, but only thermal effects, the $$\frac{\delta^2(\log(\Delta P))}{\delta t^2}$$

part will be non-null and the $$\frac{\Delta T}{\Delta P}$$

part will also be non-null. The index function (5) will therefore be non-null. And in the case where there is formation flow effects, and also thermal effects, the $$\frac{\delta^2(\log(\Delta P))}{\delta t^2}$$

part will have a value practically null or will tend towards zero, and the $$\frac{\Delta T}{\Delta P}$$

part will still be non-null. The index function (5) will therefore tend towards zero. So when the index function (5) tends towards zero, the build up phase is a genuine formation build up and when not, the build up phase is a non-formation build up.

Figure 5:
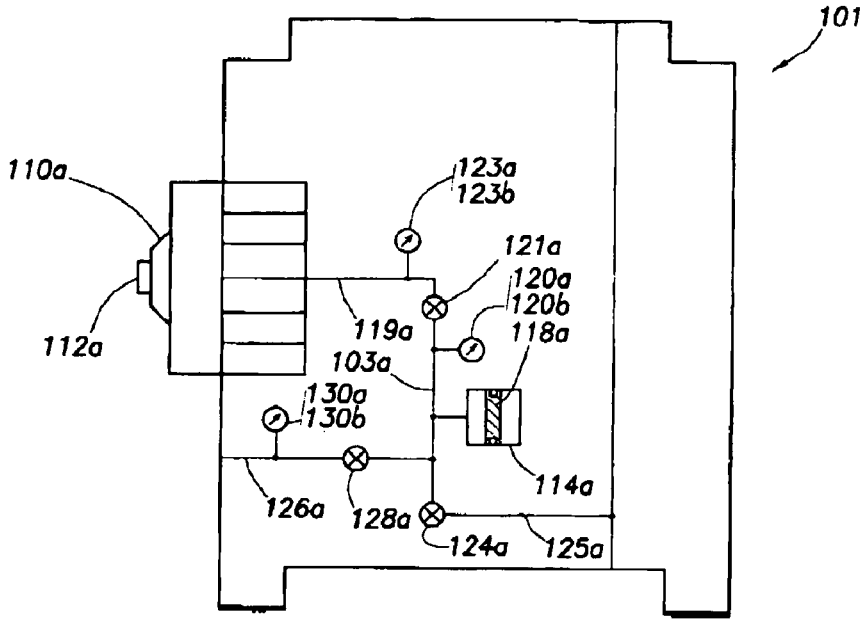
FIG. 5 shows a schematic of components of a module of a formation tester suitable for practicing embodiments of the invention.

As said before the method may be practiced with any formation tester known in the art. A version of a probe module usable with such formation testers is depicted in FIG. 5. The module 101 includes a probe 112*a*, a packer 110*a* surrounding the probe, and a flow line 119*a* extending from the probe into the module. The flow line 119*a* extends from the probe 112*a* to probe isolation valve 121*a*, and has a pressure gauge 123*a* and/or temperature gauge 123*b*. A second flow line 103*a* extends from the probe isolation valve 121*a* to sample line isolation valve 124*a* and equalization valve 128*a*, and has pressure gauge 120*a* and/or temperature gauge 120*b*. A reversible pretest piston 118*a* in a pretest chamber 114*a* also extends from flow line 103*a*. Exit line 126*a* extends from equalization valve 128*a* and out to the wellbore and has a pressure gauge 130*a* and/or temperature gauge 130*b*. Sample flow line 125*a* extends from sample line isolation valve 124*a* and through the tool. Fluid sampled in flow line 125*a* may be captured, flushed, or used for other purposes.

Probe isolation valve 121*a* isolates fluid in flow line 119*a* from fluid in flow line 103*a*. Sample line isolation valve 124*a*, isolates fluid in flow line 103*a* from fluid in sample line 125*a*. Equalizing valve 128*a* isolates fluid in the wellbore from fluid in the tool. By manipulating the valves to selectively isolate fluid in the flow lines, the pressure gauges 120*a* and 123*a* may be used to determine various pressures and temperature gauges 120*b* and 123*b* may be used to determine various temperatures. For example, by closing valve 121*a* formation pressure may be read by pressure gauge 123*a* when the probe is in fluid communication with the formation while minimizing the tool volume connected to the formation. And for example, by closing valve 121*a* formation sample temperature may be read by temperature gauge 123*b* when the probe is in fluid communication with the formation while minimizing the tool volume connected to the formation.

In another example, with equalizing valve 128*a* open mud may be withdrawn from the wellbore into the tool by means of pretest piston 118*a*. On closing equalizing valve 128*a*, probe isolation valve 121*a* and sample line isolation valve 124*a* fluid may be trapped within the tool between these valves and the pretest piston 118*a*. Pressure gauge 130*a* may be used to monitor the wellbore fluid pressure continuously throughout the operation of the tool and together with pressure gauges 120*a* and/or 123*a* may be used to measure directly the pressure drop across the mudcake and to monitor the transmission of wellbore disturbances across the mudcake for later use in correcting the measured sandface pressure for these disturbances.

Among the functions of pretest piston 118*a* is to withdraw fluid from or inject fluid into the formation or to compress or expand fluid trapped between probe isolation valve 121*a*, sample line isolation valve 124*a* and equalizing valve 128*a*. The pretest piston 118*a* preferably has the capability of being operated at low rates, for example 0.01 $cm^3 \cdot s^{-1}$, and high rates, for example 10 $cm^3 \cdot s^{-1}$, and has the capability of being able to withdraw large volumes in a single stroke, for example 100 $cm^3$. In addition, if it is necessary to extract more than 100 $cm^3$ from the formation without retracting the probe, the pretest piston 118*a* may be recycled. The position of the pretest piston 118*a* preferably can be continuously monitored and positively controlled and its position can be "locked" when it is at rest. In some embodiments, the probe 112*a* may further include a filter valve (not shown) and a filter piston (not shown).

Various manipulations of the valves, pretest piston and probe allow operation of the tool according to the described methods. One skilled in the art would appreciate that, while these specifications define a preferred probe module, other specifications may be used without departing from the scope of the invention. While FIG. 5 depicts a probe type module, it will be appreciated that either a probe tool or a packer tool may be used, perhaps with some modifications. The following description assumes a probe tool is used. However, one skilled in the art would appreciate that similar procedures may be used with packer tools.

The techniques disclosed herein are also usable with other devices incorporating a flowline. The term "flowline" as used herein shall refer to a conduit, cavity or other passage for establishing fluid communication between the formation and the pretest piston and/or for allowing fluid flow there between. Other such devices may include, for example, a device in which the probe and the pretest piston are integral. An example of such a device is disclosed in U.S. Pat. No. 6,230,557 B1 and U.S. Patent Application Ser. No. 2004/0160858, assigned to the assignee of the present invention.

Figure 6A:
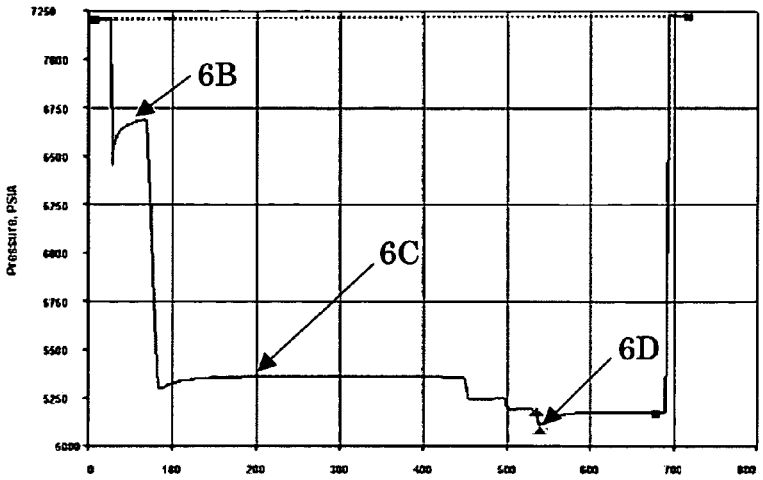
FIG. 6A shows a first example of the method applied to a pressure measurement versus time according to the present invention.
Figure 6B:
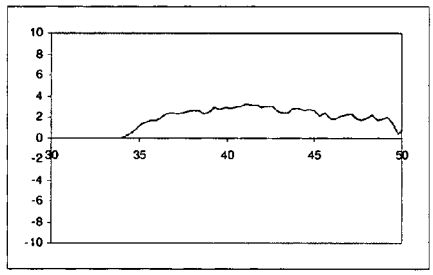
FIGS. 6B, 6C and 6D show the index according to the present invention applied to a part of the pressure measurement versus time of FIG. 6A.
Figure 6C:
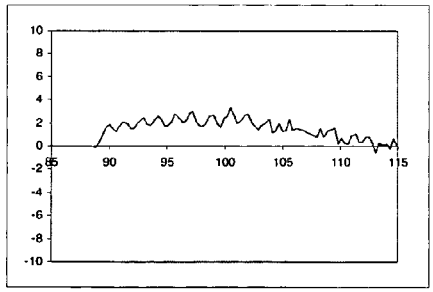
Figure 6D:
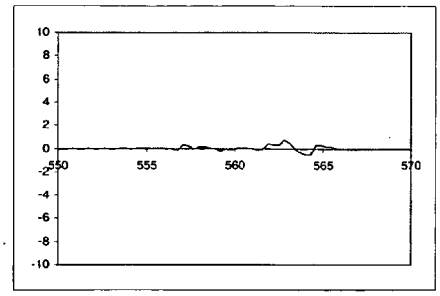

FIG. 6A is a first example of the use of the index function (5) according to the present invention, to determine if a build up phase is of the type of non-formation build up or formation build up. The values of the index function (5) are plotted for build up phases 6B, 6C and 6D of pressure measurements of FIG. 6A. As it can be shown, the build up 6B is a non-formation build up, the index function being not null; the build up 6C is a non-formation build up, the index function being also not null; and the build up 6D is a formation build up, the index function being null.

Figure 7A:
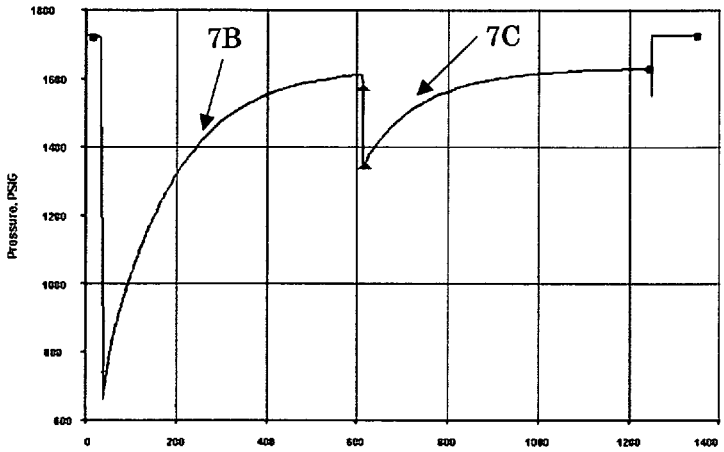
FIG. 7A shows a second example of the method applied to a pressure measurement versus time according to the present invention.
Figure 7B:
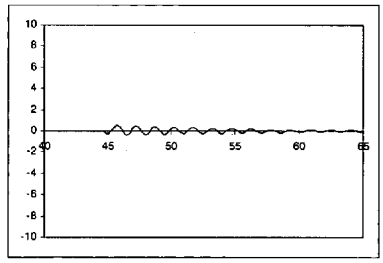
FIGS. 7B and 7C show the index according to the present invention applied to a part of the pressure measurement versus time of FIG. 7A.
Figure 7C:
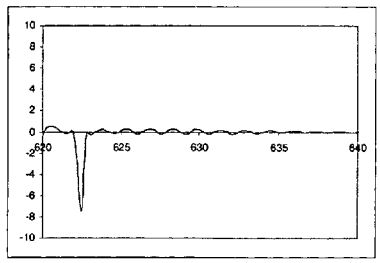

FIG. 7A is a second example of the use of the index function (5) according to the present invention. The values of the index function (5) are plotted for build up phases 7B and 7C of pressure measurements of FIG. 7A. As it can be shown, the build up 7B is a formation build up, the index function being null and the build up 7C is also a formation build up, the index function being also null.

Figure 8A:
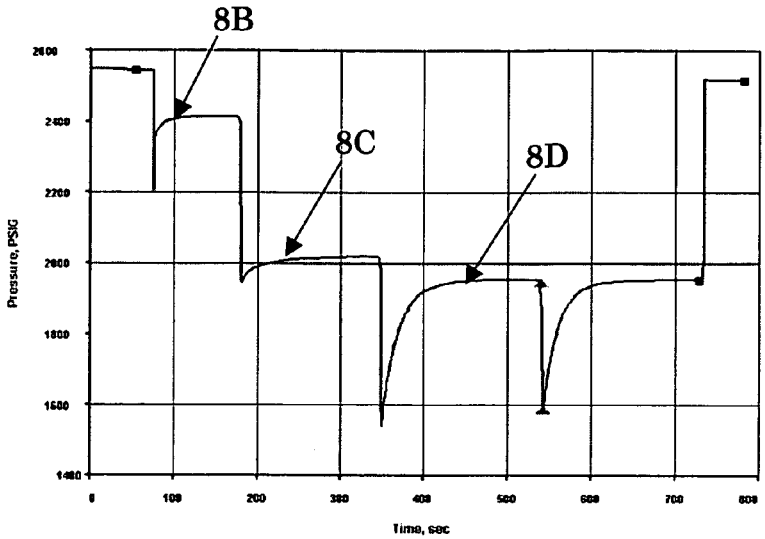
FIG. 8A shows a third example of the method applied to a pressure measurement versus time according to the present invention.
Figure 8B:
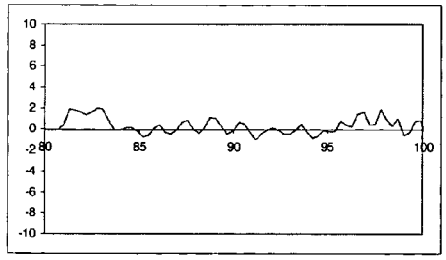
FIGS. 8B, 8C and 8D show the index according to the present invention applied to a part of the pressure measurement versus time of FIG. 8A.
Figure 8C:
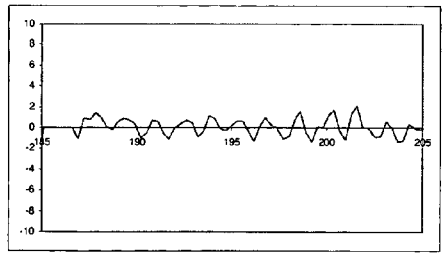
Figure 8D:
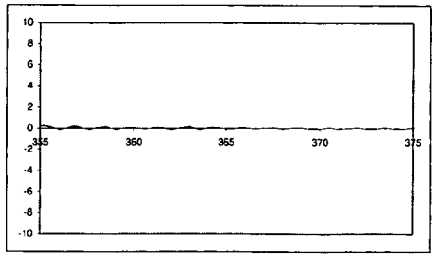

FIG. 8A is a third example of the use of the index function (5) according to the present invention. The values of the index function (5) are plotted for build up phases 8B, 8C and 8D of pressure measurements of FIG. 8A. As it can be shown, the build up 8B is a non-formation build up, the index function being not null; the build up 8C is a non-formation build up, the index function being also not null; and the build up 8D is a formation build up, the index function being null.

The invention claimed is:

1. A method for estimating type of a build up pressure phase, the build up pressure phase being done after a drawdown pressure phase, said both drawdown and build up phases being done to determine formation pressure using a formation tester disposed in a wellbore penetrating a permeable formation, said permeable formation being able to create a formation flow, said method further comprising the step of using an index to directly inform at the beginning of the build up phase for estimating said type contributing to the build-up pressure phase.

2. The method of claim 1, wherein said index is a function dependent of the effects of thermodynamic equilibrium in the formation tester and the effects of formation flow into the formation tester.

3. The method of claim 1, wherein said index is a function dependent of the effects of temperature variation in the formation tester and the effects of formation flow into the formation tester.

4. The method of claim 1, wherein said index i(t) is equal to:

$$\frac{\Delta T}{\Delta P}\cdot\frac{\delta^2(\log(\Delta P))}{\delta t^2},$$

where ΔT is the temperature variation, ΔP is the pressure variation and t the time.

5. A method for estimating a formation pressure using a formation tester disposed in a wellbore penetrating a formation, comprising:

(a) establishing fluid communication between a pretest chamber in the downhole tool and the formation via a flowline, the flowline having an initial pressure therein;

(b) moving a pretest piston in a controlled manner in the pretest chamber to reduce the initial pressure to a drawdown pressure during a drawdown phase;

(c) terminating movement of the piston to permit the drawdown pressure to adjust to a stabilized pressure during a build-up phase and measuring simultaneously in relation to time, pressure P(t) and temperature T(t) in the pretest chamber;

(d) extracting an index i(t) dependent of the pressure P(t) and the temperature T(t) informing on the build-up phase;

(e) analyzing index i(t) and repeating steps (b)-(d) or going to step (f);

(f) determining the formation pressure based on a final stabilized pressure in the flowline.

6. The method of claim 5, wherein the pretest piston is moved such that a predetermined change in volume in the flowline occurs.

7. The method of claim 5, wherein the movement of the pretest piston is controlled by controlling one of reduction of pressure in the flowline, rate of pressure change in the flowline, incremental volume change the pretest chamber and combinations thereof.

8. The method of claim 5 further comprising the step of setting the formation tester.

9. The method of claim 5, wherein said index i(t) is a function dependent of the effects of thermodynamic equilibrium in the formation tester and the effects of formation flow into the formation tester.

10. The method of claim 5, wherein said index i(t) is a function dependent of the effects of temperature variation in the formation tester and the effects of formation flow into the formation tester.

11. The method of claim 5, wherein said index i(t) is equal to:

$$\frac{\Delta T}{\Delta P}\cdot\frac{\delta^2(\log(\Delta P))}{\delta t^2},$$

where ΔT is the temperature variation, ΔP is the pressure variation and t the time.

12. The method of claim 5, wherein the pretest piston is moved at a fixed rate.

13. The method of claim 6, wherein the pretest piston is moved such that a predetermined change in volume in the flowline occurs.

14. A method for estimating type of a build up pressure phase, the build up pressure phase being done after a drawdown pressure phase, said both drawdown and build up phases being done to determine formation pressure using a formation tester disposed in a wellbore penetrating a permeable formation, said permeable formation being able to create a formation flow, said method further comprising the step of using an index to determine the contribution of formation flow on the pressure build up phase, wherein said index i(t) is equal to:

$$\frac{\Delta T}{\Delta P}\cdot\frac{\delta^2(\log(\Delta P))}{\delta t^2},$$

where ΔT is the temperature variation, ΔP is the pressure variation and t the time.

* * * * *